US011950701B1

(12) United States Patent
Goldwax et al.

(10) Patent No.: US 11,950,701 B1
(45) Date of Patent: Apr. 9, 2024

(54) FOLDABLE BED

(71) Applicant: TGD North America Furniture Inc., Oakville (CA)

(72) Inventors: Neil Goldwax, Kirkland (CA); Michael Selim, Oakville (CA)

(73) Assignee: TGD North America Furniture Inc., East Oakville (CA)

( * ) Notice: Subject to any disclaimer, the term of this patent is extended or adjusted under 35 U.S.C. 154(b) by 0 days.

(21) Appl. No.: 18/521,743

(22) Filed: Nov. 28, 2023

(51) Int. Cl.
*A47C 17/42* (2006.01)

(52) U.S. Cl.
CPC ..... *A47C 17/42* (2013.01)

(58) Field of Classification Search
CPC ..... A47C 17/38; A47C 17/40; A47C 17/42; A47C 17/48; A47C 17/46; A47C 19/22
USPC ..... 5/133, 136; 182/34
See application file for complete search history.

(56) References Cited

U.S. PATENT DOCUMENTS 995,336 A * 6/1911 Evans ..... A47C 17/40 5/162
1,349,946 A * 8/1920 Napoleon ..... A47C 17/40 5/162
1,380,502 A * 6/1921 Sinclair ..... A47C 17/40 5/162
1,497,949 A * 6/1924 Sinclair ..... A47C 17/42 5/162
1,534,296 A * 4/1925 Cane ..... A47C 17/40 5/162
1,606,596 A * 11/1926 Peek ..... A47C 17/40 5/135
1,693,795 A * 12/1928 Moore ..... A47C 17/42 5/162
2,202,248 A * 5/1940 Deschamps ..... A47C 17/42 5/136

(Continued)

FOREIGN PATENT DOCUMENTS

FR 1259481 A * 4/1961
RU 199436 U1 * 9/2020

OTHER PUBLICATIONS

"Wall Bed King Vertical Wall Beds," wallbedkingcom. https://www.wallbedking.com/en/classic [Date accessed: Jun. 29, 2023].

(Continued)

*Primary Examiner* — David R Hare
(74) *Attorney, Agent, or Firm* — Bold IP, PLLC; Binita Singh

(57) ABSTRACT

A bed configured to allow a user to maximize a living space with a functional bed that can transition from a horizontal functional position to a vertical stowed position. The bed is configured to be easily operable between these purposes with simple movements. The bed system has a wall attachment that attaches to studs in a wall and connects to a headboard that is positioned away from the wall. A pair of L-shaped support brackets connect to the wall attachment and to a mattress frame creating a pivoting connection point. A lift mechanism connects to each L-shaped support bracket and to the mattress frame. Further, a locking mechanism locks the mattress frame in the horizontal position and the vertical position to secure the mattress frame in either position. The bed provides a traditional looking bed that can be folded into the vertical position to open a floor space when needed.

31 Claims, 10 Drawing Sheets

(56) References Cited

U.S. PATENT DOCUMENTS

| | | | | | |
|---|---|---|---|---|---|
| 2,307,920 | A | * | 1/1943 | Deschamps | A47C 17/44 5/136 |
| 2,569,574 | A | * | 10/1951 | Parker | A47C 17/32 5/8 |
| 3,550,167 | A | | 12/1970 | Bennett | |
| 4,736,476 | A | * | 4/1988 | Maqueira | A47C 17/40 5/164.1 |
| 4,829,610 | A | * | 5/1989 | Gonzalez-Alvarez | A47C 17/38 5/2.1 |
| 5,446,932 | A | | 9/1995 | Voorhis | |
| 6,185,764 | B1 | | 2/2001 | Merritt | |
| 7,231,675 | B1 | * | 6/2007 | Rucinski | A47C 17/38 5/162 |
| 7,574,758 | B2 | | 8/2009 | Arason et al. | |
| 7,793,366 | B2 | * | 9/2010 | Stoltzfus | A47C 17/40 5/907 |
| 8,800,077 | B2 | | 8/2014 | Colombo | |
| 2013/0019399 | A1 | | 1/2013 | Colombo | |
| 2016/0278532 | A1 | | 9/2016 | Wilson | |
| 2017/0007028 | A1 | | 1/2017 | Grubb | |
| 2020/0367658 | A1 | | 11/2020 | Cohen | |

OTHER PUBLICATIONS

"DIY Wallbed," youtube.com. https://www.youtube.com/watch?v=984f3S8TLCQ [Date accessed: Jun. 29, 2023].

* cited by examiner

FOLDABLE BED

FIELD OF DISCLOSURE

The overall field of this invention generally relates to a bed assembly, and more specifically, to a foldable bed assembly adapted to swing between a horizontal and vertical plane.

BACKGROUND

Living spaces are becoming relatively smaller due to the exponential rise in the cost of real estate. Lifestyles and the high-tech age are driving people to bigger and more populous cities. The same factors are also driving the cost of homes and apartments in these cities. At the same time, people are looking to simplify their busy lives by moving closer to their jobs, which may be in an urban setting or simplify their lives by getting smaller homes. In all these situations, the living environments are often less spacious where one room may serve several purposes. As such, convertible furniture, such as a wall bed is a useful and beneficial piece of furniture. Generally, a wall bed is a bed that is hinged at one end to store vertically against a wall, or inside a closet or cabinet.

However, wall beds are generally intended to be stored vertically against a wall, inside a closet or a cabinet. Their function is to be in the stored position most of the time and pulled down to a horizontal position when needed to be used as a bed. Thus, the floor space is mostly available. Not all users need a murphy bed but may occasionally need to transform the room with a bed to maximize space for an activity. Here, the floor space is required on occasion and a wall bed, such as a murphy bed, would be a big investment for such a purpose. Thus, in this scenario, when a user needs the floor space, the bed can be lifted out of the way. There are a few beds that offer this solution, however, most of them attach to the floor and hence damage the floor.

Thus, there exists a need for an improved bed which does not attach to the floor and can be lifted to make a room with the bed into a multipurpose room.

SUMMARY

Accordingly, the present disclosure recognizes the unsolved need for a foldable bed that does not damage a floor the bed is placed on. The present disclosure includes a lifting mechanism that attaches to the studs in a wall and thus secures the bed to the wall requiring much less damage to the wall. The invention as presently described will allow the room with a foldable bed to have more space when needed with simple movements. Thus, this invention addresses the reduction in living space requirements and associated cost per square feet.

In a non-limiting embodiment, a foldable bed is provided which comprises a pair of support brackets, a wall attachment, a mattress frame, and one or more straps. The foldable bed may also include a headboard, a footboard, and a mattress frame cover. The pair of support brackets are connected to the wall attachment. The mattress frame is connected to the pair of support brackets, and the mattress frame is capable of pivoting at a connection point with the pair of support brackets. The footboard helps to support the mattress frame when the mattress frame is in a horizontal functional position (down position). The headboard is also attached to the wall attachment and is positioned away from the wall to provide a traditional bed look, like most beds which are not connected to a wall. The headboard and footboard also provide a decorative element to the bed and can vary in style and substrate. A pair of straps hold the mattress in place when the mattress frame is pivoted upwards into a vertical position. The mattress frame cover covers a bottom surface of the mattress frame for aesthetic purposes when the mattress frame is raised into the vertical position.

In this respect, before explaining the current embodiments of the folding bed in detail, it is to be understood that the folding bed is not limited in its applications to the details of construction and arrangements of the components set forth in the following description or illustration. Those skilled in the art will appreciate that the concept of this disclosure may be readily utilized as a basis for the design of other structures, methods, and systems for carrying out the purpose of the folding bed.

It is therefore important that the claims be regarded as including such equivalent construction insofar as they do not depart from the spirit and scope of the wall bed with removable fireplace and adjustable workstation. It is also to be understood that the phraseology and terminology employed herein are for purposes of description and should not be regarded as limiting.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
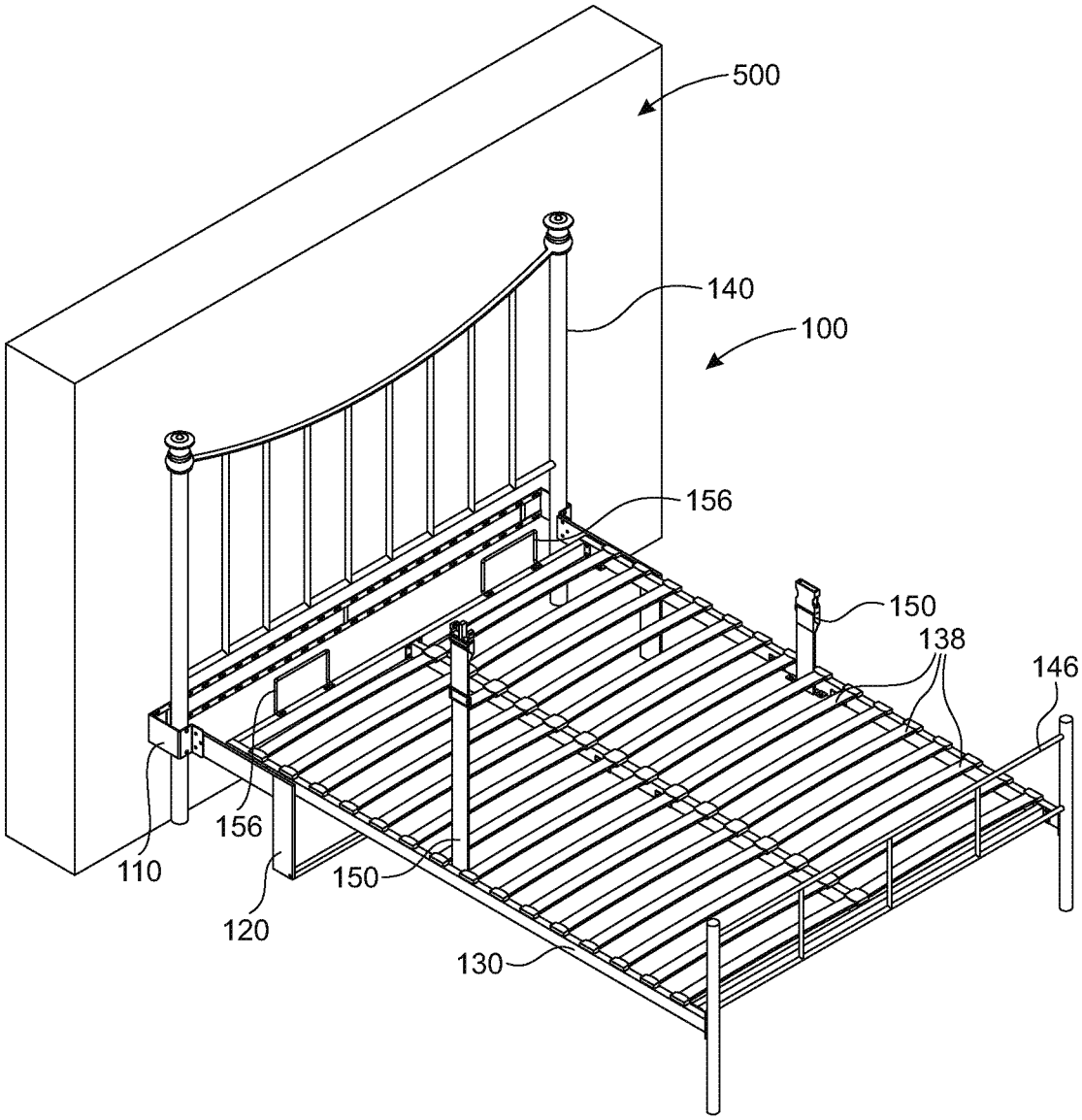
FIG. 1 depicts an illustration of a perspective view of a folding bed in a horizontal position in accordance with an illustrative embodiment.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature may also be used, to the extent possible, in combination with and/or in the context of other particular aspects and embodiments of the invention, and in the invention generally.

Where reference is made herein to a method comprising two or more defined steps, the defined steps may be carried out in any order or simultaneously (except where the context excludes that possibility), and the method may include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any items, so a "set of items" may indicate the presence of only one item or may indicate more items. Thus, the term "set" may be equivalent to "one or more" as used herein.

Figure 2:
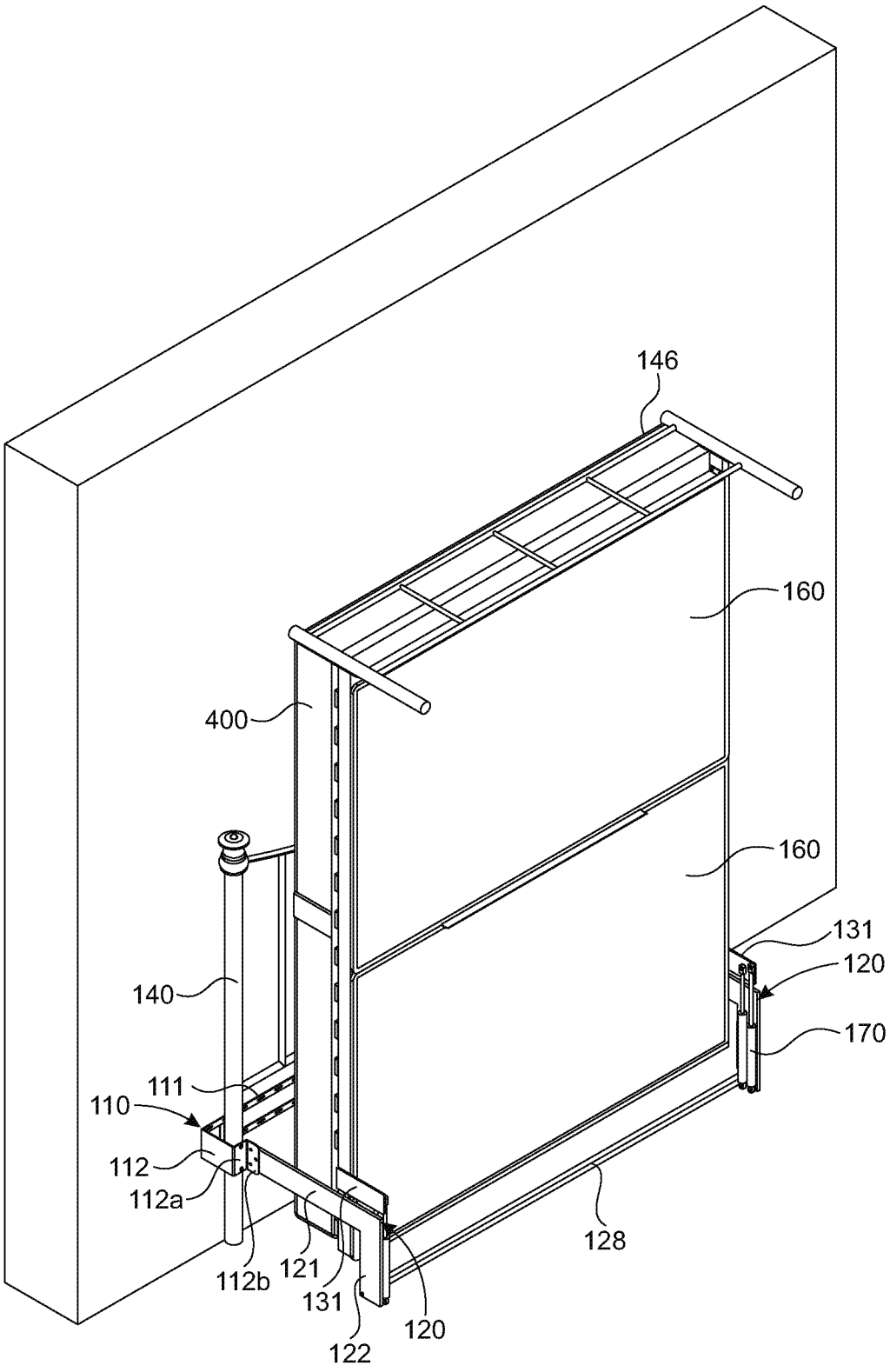
FIG. 2 depicts an illustration of the folding bed in a vertical position in accordance with an illustrative embodiment.

In referring to the figures, a non-limiting embodiment of a folding bed is illustrated in FIGS. 1 through 10 and generally indicated as a folding bed 100. The folding bed 100 of the present invention is designed to pivot between a horizontal functional position and a vertical stowed position adjacent to a wall the folding bed 100 is connected to. The folding bed 100 is constructed to be easily operable between these positions with simple movements. FIGS. 1 and 2 illustrate a perspective view of the folding bed 100 in the horizontal position and the vertical position, respectively. The folding bed 100 is shown as comprising of a wall attachment 110, a pair of support brackets 120, a mattress frame 130, a headboard 140, and a footboard 146. Further, the folding bed 100 also comprises a strap 150, an aesthetic cover 160, and a lifting mechanism 170. Thus, the folding bed 100 as shown addresses a reduction in living space requirements and/or the need to open floor space as needed.

Figure 3:
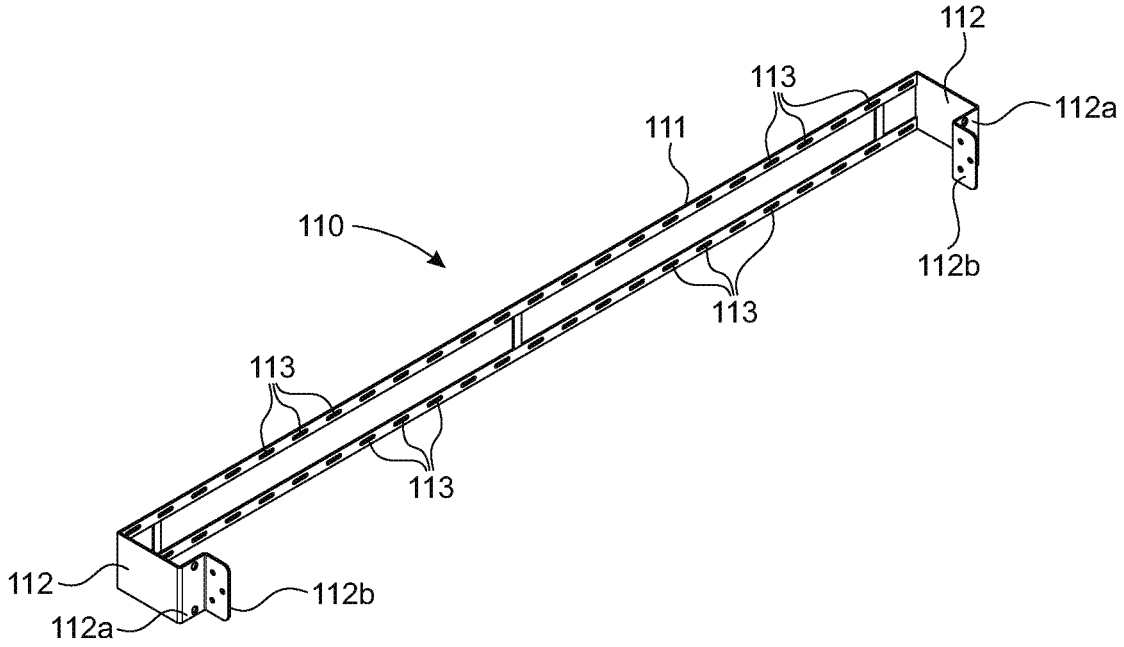
FIG. 3 depicts an illustration of the wall attachment in accordance with an illustrative embodiment.

As seen in the non-limiting embodiment in FIG. 1, the folding bed 100 is in a horizontal functional position and is shown without a mattress to illustrate the specific features of the folding bed 100. As shown in the figure, the folding bed 100 is affixed to a wall 500 which secures and provides overall support for the folding bed 100. It can be seen that the wall attachment 110 functionally adjoins the folding bed 100 to the wall 500. FIG. 3 illustrates the wall attachment 110 which is shown to include a flat plate 111 having two ends wherein each end is bent at a 90-degree angle to form a first segment 112. The first segments 112 extend perpendicularly away from the flat plate 111 and are parallel to each other. Each of the first segments 112 extends into a second segment 112*a* which is bent inward at a 90-degree angle making each second segment 112*a* parallel to the flat plate 111. A third segment 112*b* extends at a 90-degree angle from an end of each of the second segments 112*a*. The third segments 112*b* also extend perpendicularly away from the flat plate 111 and are parallel to each other and to the first segments 112.

The flat plate 111 of the wall attachment 110 includes multiple holes 113 that extends an entire length of the flat plate 111. In FIG. 3, an example arrangement of the multiple holes 113 is shown on the flat plate 111, wherein the multiple holes 113 are arranged in two rows. It is to be understood that the arrangement of the multiple holes 113 in FIG. 3 is an example, and other arrangements are also possible, such as a single row, or more than two rows, or staggered, etc. In any scenario or arrangement, the multiple holes 113 allow the wall attachment 110 to be securely connected to one or more studs in the wall (see, wall 500, FIG. 1 or FIG. 4). To attach the folding bed 100 to a wall, a user can locate one or more studs in the wall and then attach the wall attachment 111 by using fasteners in the appropriate holes 113 that align with the studs in the wall attachment 111. Each multiple hole 113 has an oblong shape allowing flexibility and ease of aligning appropriately with the studs in the wall. Connecting the wall attachment 110 to the studs ensures a secure connection of the folding bed to the wall 500, and also prevents any damage to a wall that can occur by securing only into a dry wall.

Figure 4:
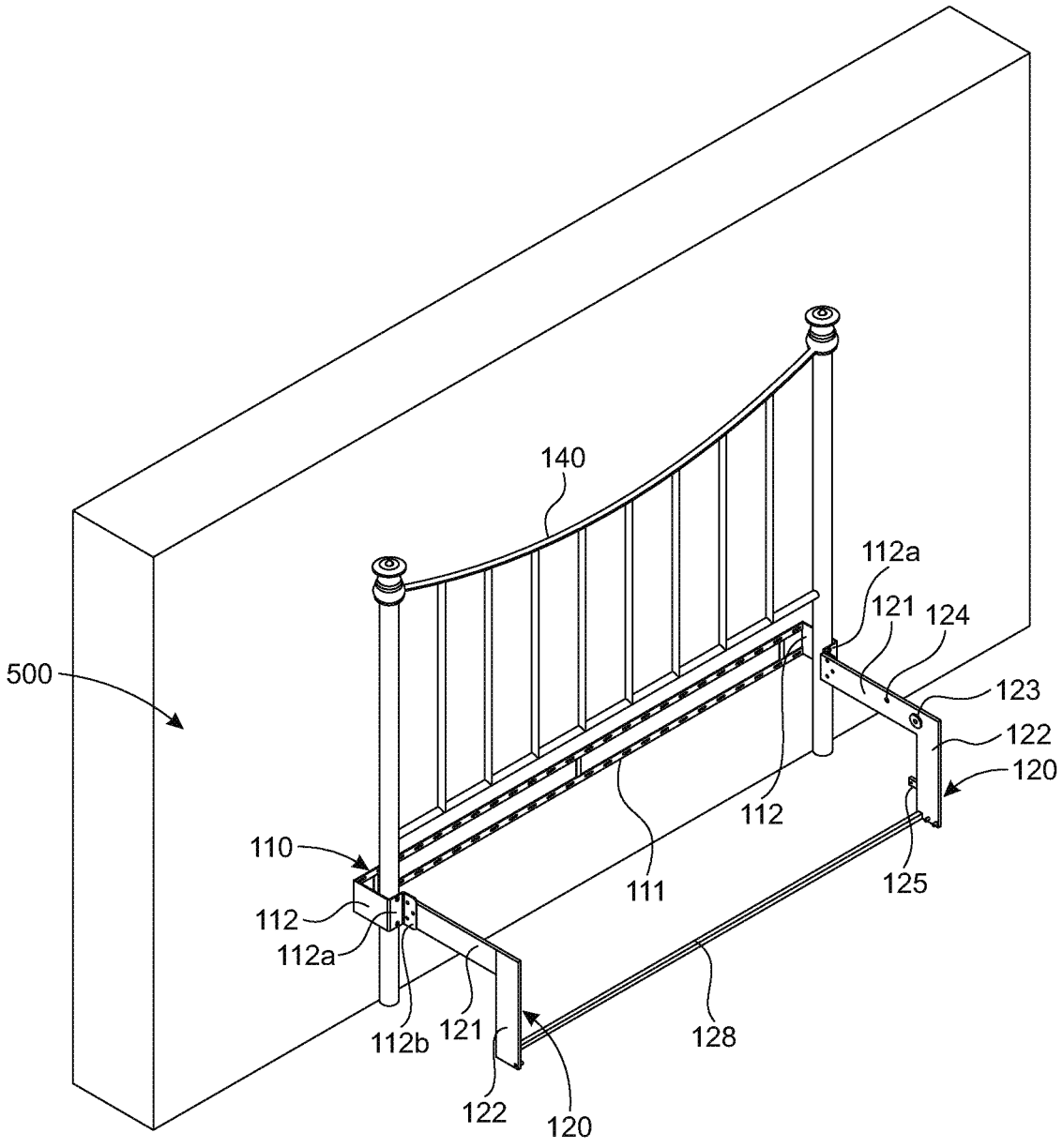
FIG. 4 depicts an illustration of an adjoined wall attachment and a pair of support brackets of the folding bed system in accordance with an illustrative embodiment.
Figure 8:
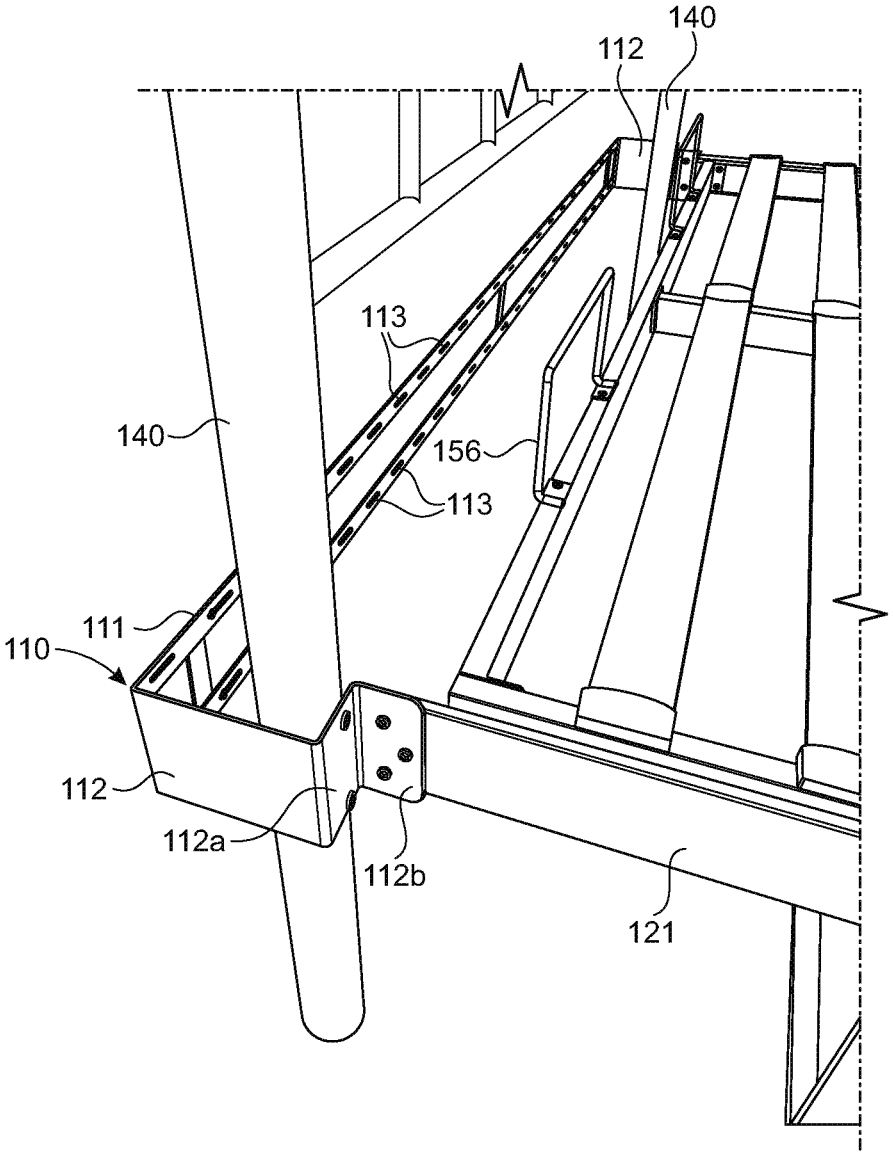
FIG. 8 depicts an illustration of a close-up view of a connection of headboard to wall attachment of the folding bed in accordance with an illustrative embodiment.
Figure 9:
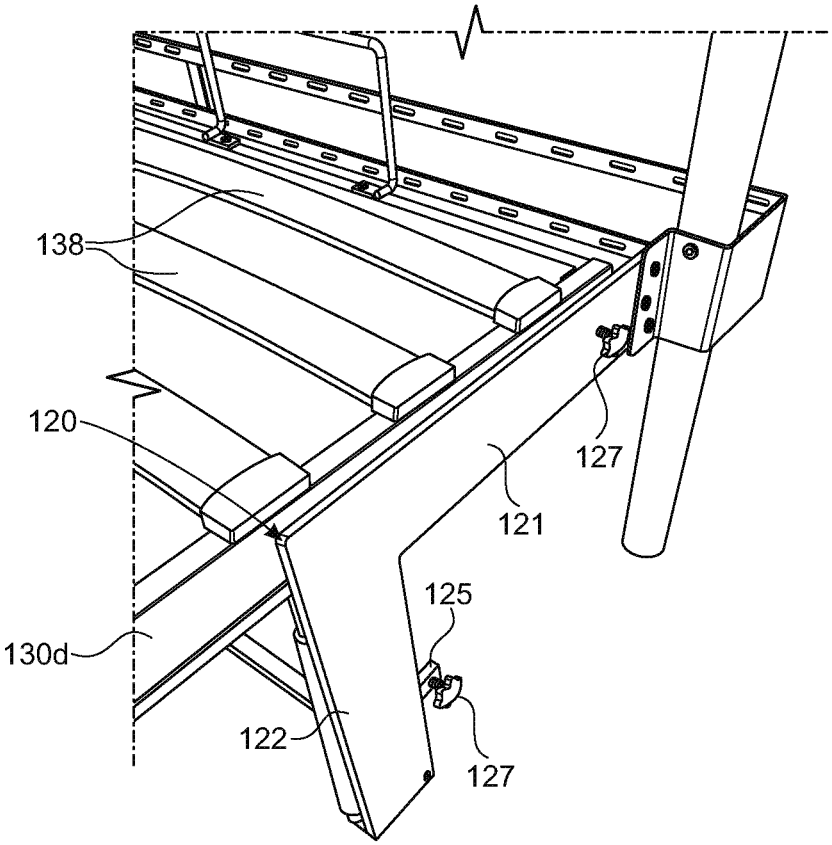
FIG. 9 depicts an illustration of a side view of a locking mechanism in accordance with an illustrative embodiment.

FIG. 4 illustrates a perspective view of the folding bed 100 showing only the wall attachment 110, the pair of support brackets 120, and the headboard 140. As can be seen, the wall attachment 110 is configured to attach to the pair of support brackets 120 and to the headboard 140. The headboard 140 structure is constructed as a decorative element. Notwithstanding the design, the headboard 140 includes a pair of legs which rest on the floor. Referring to FIG. 8, a closeup view is shown of the headboard 140 attached to the wall attachment 110. The pair of legs 141 on the headboard 140 are joined to an inner surface of the second segment 112*a* on the wall attachment 110. As is best seen in FIG. 4, the inner surfaces of the second segments 112*a* face toward the flat plate 111 of the wall attachment 110. Also seen in the figure, the pair of legs 141 are joined to the second segments 112*a* by one or more fasteners. However, it is to be understood that the pair of legs 141 can be joined to the wall attachment 110 by other means, such as welding.

FIG. 8 also illustrates that the headboard 140, as connected to the wall attachment 110, is positioned away from the flat plate 111. Thus, the headboard 140 is also positioned away from the wall the folding bed 100 will be connected to. Thus, the positioning provides an aesthetically pleasing traditional bed appearance and prevents damage to the wall the folding bed 110 may be connected. Furthermore, to maintain an aesthetically pleasing look to the folding bed 100, the headboard 140 and a mattress positioned on the mattress frame 130 will be positioned relative to each other such that there is not a substantial gap between the two. The distance of the headboard 140 from the wall allows the mattress frame 130 with the mattress to move horizontally and vertically unencumbered by the wall. Thus, the positioning of the headboard 140 provides enough of a clearance for the mattress and the mattress frame 130 to pivot.

As best seen in FIG. 4, the pair of support brackets 120 is also connect to the wall attachment 110. Each support bracket 120 is positioned on either end of the wall attachment 110 and connected to each other by a support bar 128 which is parallel to the flat plate 111 of the wall attachment 110. The support bar 128 rests on the floor but is not attached to the floor by any fixture means. The support bar 128 provides structural support to the support brackets 120. Each support bracket of the pair of brackets 120 has an L-shape which has a first arm 121 and a second arm 122. The first arm 121 is positioned parallel to a floor surface and the second arm 121 extends perpendicularly from the first arm 121 to rest on the floor surface The pair of support brackets 120 are connected to the third segment 112*b* on the wall attachment 110. Specifically, the first arm 121 of the support bracket 120 is placed against an inside facing side of the third segment 112*b* and affixed by any means known in the art, such as using fasteners or welding. A can be seen, the second arm 122 rests on the floor surface and has a length that is commensurate with the positioning of the wall attachment 110 on a wall. For example, the second arm 122 may have a length of twelve inches, and thus, a top edge of the wall attachment 110 will be positioned and secured approximately 12 inches above the floor surface. It is also to be understood that the support brackets 120 could be manufactured with the wall attachment 110 as one single piece.

Figure 5:
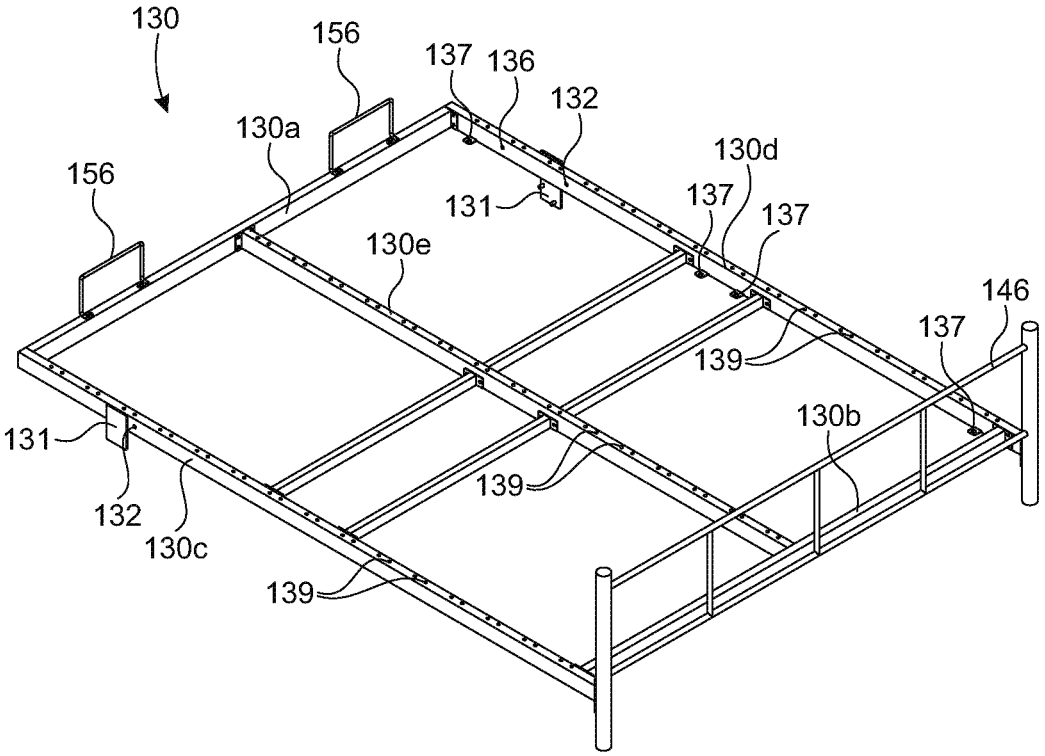
FIG. 5 depicts an illustration of the mattress frame of the folding bed in accordance with an illustrative embodiment.

Each of the support brackets 120 also connect with the mattress frame 130, such that the mattress frame 130 is capable of pivoting at a connection with the support brackets 120. Refer to FIGS. 4 to 7 for a description of the pivoting connection between the mattress frame 130 and the support brackets 120. The mattress frame 130 has a standard appearance in that it includes a first edge 130*a* and a second edge 130*b*, which are coincidental with a head and foot end of the folding bed 100, respectively. The first edge 130*a* and the second edge 103*b* are also joined by a pair of sides 130*c* and 130*d*. As seen in FIG. 5, an outside surface on each mattress frame side 130*c*, 130*d* includes a plate 131 which is used to connect with the lifting mechanism 170, which is shown in FIG. 2. The lifting mechanism 170 is connected to the plate 131 and to the second arm 122 on the support bracket 120. The mattress frame 130 is lifted and lowered with the aid of the lifting mechanism 170. FIG. 2 provides a clear view of an example of the lifting mechanism 170. The lifting mechanism 170 can be any lifting mechanism known in the arts, such as a gas piston, a hydraulic piston, springs, and others.

Figure 6:
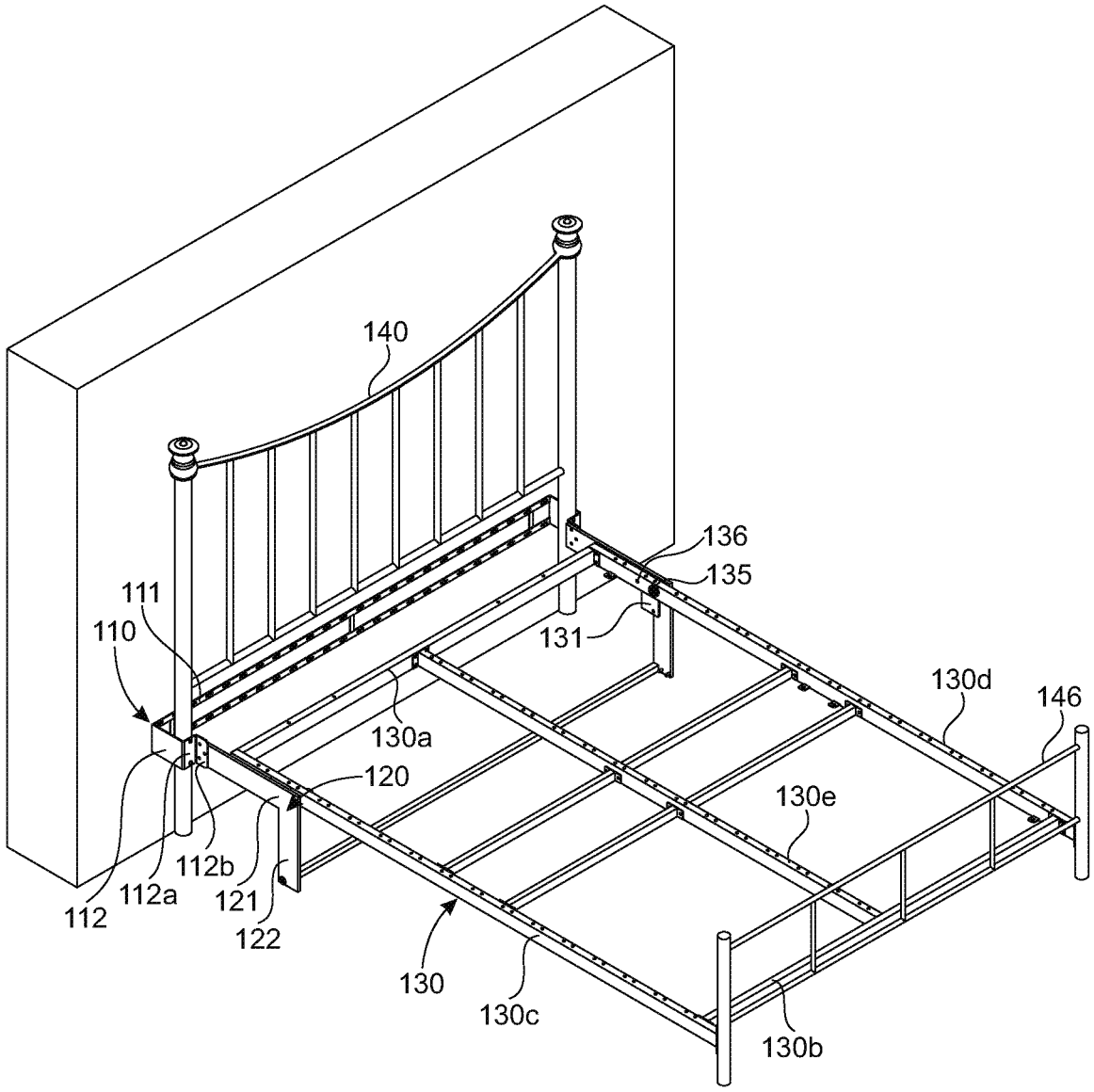
FIG. 6 depicts an illustration of the mattress frame attached to the support bracket in accordance with an illustrative embodiment.
Figure 7:
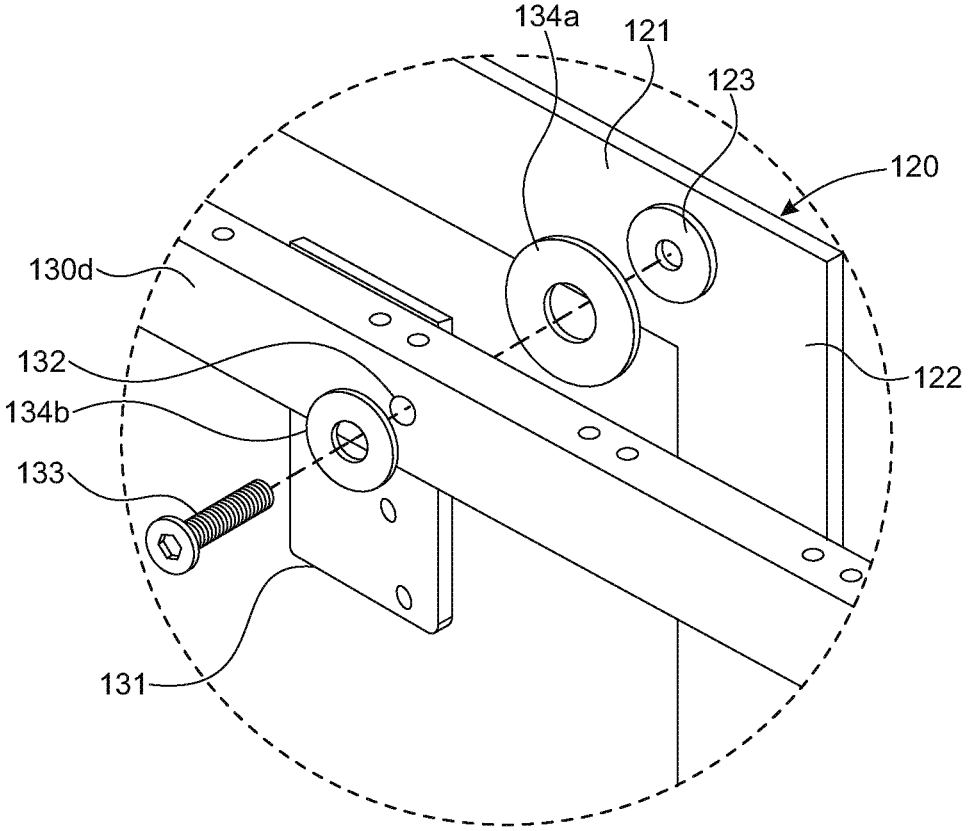
FIG. 7 depicts an illustration of a close-up view of a pivoting connection point of the mattress frame and a single support bracket in accordance with an illustrative embodiment.

Referring to FIG. 5, the left and right sides 130*c*, 130*d* of the mattress frame 130 include an opening each, referred to as first opening 132. The first opening 132 on each side 130*c*, 130*d* is adjacent to the plates 131. FIGS. 4 and 6 illustrate the best view of an inside facing surface of one of the support brackets 120. The description that follows is relevant to both support brackets 120. It is shown that the support bracket 120 in FIG. 4 includes a bolt 123 which is welded onto the inside facing surface on the first arm 121 of the support bracket 120. A closer look in FIG. 7 illustrates how the pivoting connection of the mattress frame 130 with the support bracket 120 is established. The mattress frame 130 is positioned relative to the support bracket 120 by aligning the first openings 132 on the mattress frame 130 with the bolt 123 on the support bracket 120. Once the mattress frame 130 is aligned with the support bracket 120, a fastener 133 is inserted through the first opening 132 in the mattress frame 130 and into the bolt 123 on the support bracket 120. A first washer 134*a* is disposed between the mattress frame 130 and the bolt 123, and a second washer 134*b* is disposed between the fastener and the mattress frame 130, which allow the mattress frame 130 to pivot smoothly at this connection with the support bracket 120. As shown in FIG. 6, the connection of the mattress frame 130 to the support bracket 120 will be referred to as a pivoting connection point 135 which is established by adjoining the first openings 132 on the mattress frame 130 to the bolt 123 on the support bracket 120 and including the washers 134*a*, 134*b*. The pivoting connection point 135 is shown in FIG. 6 which illustrates the mattress frame 130 connected to the support brackets 120.

As mentioned above, the mattress frame 130 pivots at the connection point 135 with the support bracket 120. The mattress frame 130 can be locked in the horizontal functional position and in the vertical stowed position. Referring to FIGS. 4, 5 and 9-11, an example of a locking mechanism is shown, wherein the locking mechanism is used to lock the mattress frame 130 in the relative positions. The locking mechanism includes a second opening 136 in the right side 130*d* of the mattress frame, a third opening 124 in the first arm 121 of the support bracket 120, a tab 125 extending from the second arm 122 of the support bracket, and one or more knobs 127. In this non-limiting embodiment, the locking mechanism features are only included on the support frame 120 side associated with the right side 130*d* of the mattress frame 130. It will be readily appreciated that the locking mechanism may alternatively be included on the support frame 120 side associated with the left side 130*c* of the mattress 130. Or the locking mechanism could be included on both support frames 120.

Figure 10:
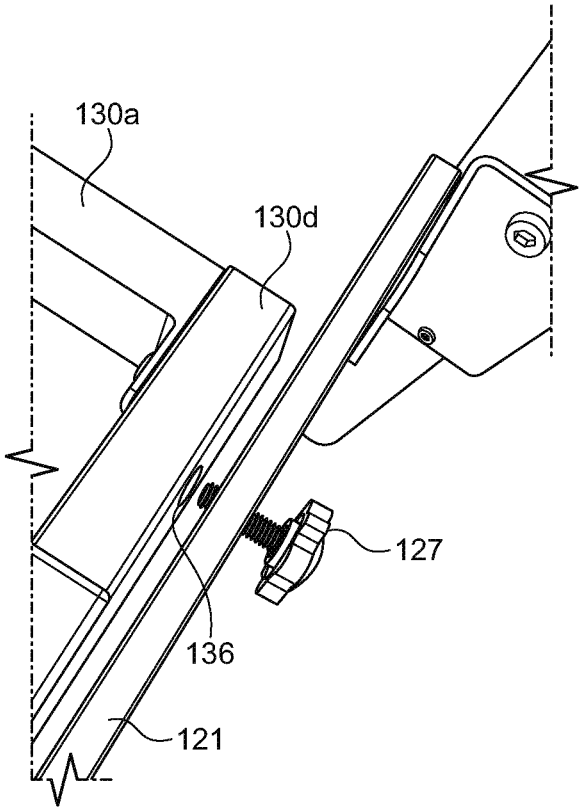
FIG. 10 depicts an illustration of a top view of the locking mechanism in an unlocked position in accordance with an illustrative embodiment.
Figure 11:
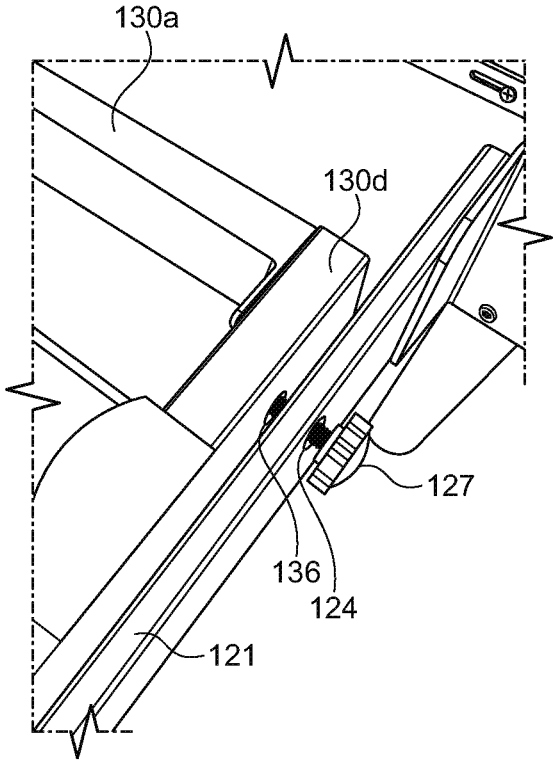
FIG. 11 depicts an illustration of a top view of the locking mechanism in a locked position in accordance with an illustrative embodiment.

FIGS. 10 and 11 help demonstrate how the locking mechanism is utilized by locking the mattress frame in the horizontal position. FIG. 10 illustrates the mattress frame in the horizontal position before locking the mattress in this position. As shown, the knob 127 is not inserted through the second hole 136 in the right side 130*d* of the mattress frame. FIG. 11 illustrates the knob 127 is included in the third hole 124 on the first arm 121 of the support bracket 120, and the knob 127 is inserted through the second hole 136 in the left side 130*d*. Thus, when the mattress frame 130 is in the horizontal position, the second hole 136 in the left side 130*d* of the mattress frame 130 aligns with the third hole 124 in the first arm 121 of the support bracket 120. Aligned as such, the knob 127 can be inserted into the second hole 136 to lock the mattress frame 130 to the support bracket 120. In a similar fashion, the knob 127 can be removed from the second hole 136 to unlock the mattress frame 130 from the support bracket 120 allowing the mattress frame 130 to pivot.

Referring back to FIG. 9, the tab 125 on the second arm 122 of the support bracket 120 locks the mattress frame in the vertical position. The tab 125 juts out from the second arm 122 toward the first end of the mattress frame 130. The tab 125 also includes an opening which accommodates the knob 127. Thus, when the mattress frame 130 is in the vertical position, the second hole 136 in the left side 130*d* of the mattress frame 130 aligns with the tab 125 on the second arm 122 of the support bracket 120. Aligned as such, the knob 127 in the tab 125 can be inserted into the second hole 136 to lock the mattress frame 130 to the support bracket 120 in the vertical position. In a similar fashion, the knob 127 can be removed from the second hole 136 to unlock the mattress frame 130 from the support bracket 120 allowing the mattress frame 130 to pivot to the horizontal position.

The mattress frame 130 also includes slats 138 that fit onto the mattress frame 130 to provide a base for a mattress. The slats 138 can be arranged and affixed on the mattress frame 130 in any way known in the arts. FIG. 1 illustrates an example of the slats 138 which are shown to be arranged from the left side 130*c* to the right side 130*d*. In this example, the slats may include pegs on a first end, a second end, and a middle which can be inserted into corresponding holes 139 arranged in the left side 130*c*, the right side 130*d*, and a middle bar 130*e* of the mattress frame 130. It is to be understood that any other style and means of attachment of the slats 138 are within the disclosure of this invention.

FIGS. 1 and 5 also illustrate one or more guardrails 156 that are included on the first end 130*a* of the mattress frame 130. The guardrails 156 are included to support a mattress in place when the mattress frame 130 when the latter is pivoted into and out of the vertical position. FIG. 2 illustrates the mattress frame 130 with a mattress 400 in the vertical position, and the guardrails 156 essentially prevent the mattress from slipping down from the first end 130*a* when in the vertical position. Additionally, one or more straps 150 are also included on the mattress frame 130 which are used to wrap around a mattress when choosing to pivot the mattress frame 130 into the vertical position. In FIG. 1, a buckle type strap is shown as an example of the one or straps 150 that can be included. It is to be understood that any type of strap know in the arts can be used with this invention. The strap 150 is also shown to be positioned at a relative center of the left and right side 130*c*, 130*d* of the mattress frame 130, however, the strap 150 can be positioned at any location that would allow proper functioning and also more than one strap 150 can be positioned relative to the other to allow proper and secure support to the mattress when positioned vertically.

FIG. 2 further illustrates the aesthetic covers 160 which are included on the bottom side of the mattress frame to provide a more aesthetic look when the mattress frame 130 is in the vertical position. The aesthetic covers 160 are provided in a mattress frame 130 which are attached to the bottom side of the mattress frame 130. FIG. 5 provides an example of how the aesthetic covers 160 may be attached to the mattress frame 130. The mattress frame 130 includes several connection tabs 137 which are shown on the right side 130*d*; however, the connection tabs 137 are mirrored on the left side 130*c* also. The aesthetic covers 160 are attached to the bottom side of the mattress frame 130 to these connection tabs 137 by using fasteners. It is to be understood that any other means of attachment are also within the disclosure of this invention. The aesthetic covers 160 can be fashioned from any material including cloth, plastic, wood, or a combination. As shown, the aesthetic covers 160 are provided as two pieces, which are intended to be white boards that can be used as a dry erase board. However, the aesthetic covers can be provided in more numbers or as a single piece that fits over the entire bottom side of the mattress frame 130.

In use, the folding bed 100 may provide a standard bed within a room when the folding bed 100 is in the horizontal functional position. When it is desired to open the floor space for another activity, the folding bed 100 can be arranged to the vertical stowed position. As described above, the mattress frame 130 pivots between the horizontal and vertical positions, and for safety, the mattress frame 130 can be locked in these positions. Additionally, the folding bed 100 is attached to the stud in a wall and therefore damage to the wall and floor is eliminated or reduced.

Accordingly, the present description provides one or more embodiments for a useful wall bed system. It may be an advantage of the wall bed system, as described herein in one or more embodiments, that a user may maximize their living space with a functional bed that can transform from daytime use to nighttime use. In one exemplary embodiment, the wall bed system is provided with a fireplace that has an embedded television which can function both as a television and be used to display a fire via an external source connected to the television via its USB port. Additionally, the fireplace may be removed with ease and transferred to another part of the room. Another advantage of the embodiments described herein is the feature of an adjustable workstation so a user may work either standing up or sitting down to suit their preference. These features are not present in other wall bed systems. Thus, the wall bed system, as described in one or more non-limiting embodiments throughout this document, offers an improved device for functionally maximizing a small living space.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What may be claimed is:

1. A bed, comprising:

a wall attachment including a flat plate having a first end and a second end, wherein each of the first and second ends extend into a first segment bent at a 90-degree angle from the flat plate, each first segment extends into a second segment bent inward at a 90-degree angle parallel to the flat plate, and each second segment extends into a third segment bent at a 90-degree angle extending perpendicularly away from the flat plate;

a first support bracket and a second support bracket, wherein the first support bracket is connected to the first end of the wall attachment and the second support bracket is connected to the second end of the wall attachment, and wherein the first and second support brackets rest on a floor surface;

a mattress frame connected to the first and second support brackets at a pivoting connection point; and wherein the wall attachment secures the bed to a wall, and the mattress frame pivots between a horizontal functional position and a vertical stowed position at the pivoting connection point.

2. The bed of claim 1, wherein the flat plate of the wall attachment includes a row of multiple holes extending an entire length of the flat plate, wherein the flat plate is fastened to one or more studs in the wall through one or more holes of the multiple holes that align with the one or more studs in the wall.

3. The bed of claim 1, wherein each of the first and second brackets includes a first arm and a second arm.

4. The bed of claim 3, wherein:

the first arm of the first support bracket is connected to an inside surface of the third segment on the first end of the flat plate; and the first arm of the second support bracket is connected to an inside surface of the third segment on the second end of the flat plate.

5. The bed of claim 3, wherein the pivoting connection at each connection of the mattress frame to the first and second support brackets includes:

a first opening in each of a left side and a right side of the mattress frame;

a bolt welded on an inside surface of the first arms on each of the first and second support brackets; and wherein the mattress frame is fitted between the first and second support brackets and the first opening on each of the left and right sides of the mattress frame is aligned with the bolt in the adjacent first arms of the left and right support brackets, and wherein a washer is disposed between the first opening and the bolt of each pivoting connection.

6. The bed of claim 3, further including a locking mechanism, wherein the locking mechanism is included on the first and/or second support bracket, and comprises:

a second opening in a right side and/or a left side of the mattress frame;

a third opening in the first arm of the first and/or second support bracket;

a tab with an opening extending from the second arm of the first and/or second support bracket; and wherein a knob is inserted through the second opening and the third opening to lock the mattress frame in the horizontal functional position, and wherein the knob is inserted through the tab with an opening and the third opening to lock the mattress frame in the vertical stowed position.

7. The bed of claim 1, further including a headboard, wherein the headboard includes legs that are connected to an inside facing surface of the second segment, wherein the headboard is positioned away from the wall the wall attachment is connected to.

8. The bed of claim 1, further including a first lift mechanism connected from the first support bracket to a left side of the mattress frame and a second lift mechanism connected from the second support bracket to a right side of the mattress frame.

9. The bed of claim 1, wherein the mattress frame includes:

one or more guardrails on a first end; and one or more straps connected to a left and right side of the mattress frame to secure a mattress placed on the mattress frame.

10. The bed of claim 1, wherein one or more covers are included on a bottom surface of the mattress frame and the one or more covers can be chosen from cloth, wood, and/or white board.

11. A bed, comprising:

a wall attachment including a flat plate having a first end and a second end, wherein each of the first and second ends extend into a first segment bent at a 90-degree angle from the flat plate, each first segment extends into a second segment bent inward at a 90-degree angle parallel to the flat plate, and each second segment extends into a third segment bent at a 90-degree angle extending perpendicularly away from the flat plate;

a first support bracket and a second support bracket connected to the wall attachment, wherein each of the first and second support brackets include a first arm and a second arm connected to each other, wherein the first and/or second arms are configured to rest on a floor;

a pivoting connection point included at each of the first and second support brackets, wherein the pivoting connection point is assembled by connecting a left side of a mattress frame to the first support bracket and connecting a right side of the mattress frame to the second support bracket; and wherein the wall attachment secures the bed to a wall, and the mattress frame pivots between a horizontal functional position and a vertical stowed position at the pivoting connection point.

12. The bed of claim 11, wherein the flat plate of the wall attachment includes one or more rows of multiple holes extending an entire length of the flat plate, wherein the flat plate is fastened to one or more studs in the wall through one or more holes of the multiple holes that align with the one or more studs in the wall.

13. The bed of claim 11, wherein:

the first arm of the first support bracket is connected to an inside surface of the third segment on the first end of the flat plate; and the first arm of the second support bracket is connected to an inside surface of the third segment on the second end of the flat plate.

14. The bed of claim 11, further including a headboard, wherein the headboard includes legs that are connected to an inside facing surface of the second segment, wherein the headboard is positioned away from the wall the wall attachment is connected to.

15. The bed of claim 11, wherein the pivoting connection point at each connection of the mattress frame to the first and second support brackets includes:

a first opening in each of the left side and the right side of the mattress frame;

a bolt welded on an inside surface of each of the first arms of the first and second support bracket; and wherein the mattress frame is fitted between the first and second support brackets and the first opening on each of the left and right sides of the mattress is aligned with the bolt in the adjacent first arm of the first and second support brackets, and wherein a washer is disposed between the first opening and the bolt of each pivoting connection point.

16. The bed of claim 11, further including a locking mechanism, wherein the locking mechanism is included on the first and/or second support bracket, and comprises:

a second opening in the right side and/or the left side of the mattress frame;

a third opening in the first arm of the first and/or second support bracket;

a tab with an opening extending from the second arm of the first and/or second bracket; and wherein a knob is inserted through the second opening and the third opening to lock the mattress frame in the horizontal functional position, and wherein the knob is inserted through the tab with an opening and the third opening to lock the mattress frame in the vertical stowed position.

17. The bed of claim 11, wherein the mattress frame includes:

one or more guardrails on a first end; and one or more straps along a left and right side of the mattress frame to secure a mattress placed on the mattress frame.

18. The bed of claim 11, wherein a second end of the mattress frame is attached to a foot board.

19. The bed of claim 11, further including a lift mechanism included at each of the left and right support bracket and connected to the left and right side of the mattress frame, respectively.

20. The bed of claim 19, wherein a plate is configured on an outside surface of each of the left and right side of the mattress frame adjacent to the pivoting connection point, wherein the plate on each of the left and right side of the mattress frame extends downward past an edge of each of the left and right sides, wherein, the lift mechanism on each of the left and right sides of the mattress frame is affixed to an inside facing surface of the plate that extends past the edge of each of the left and right sides, and the lift mechanism extends from each of the left and right sides of the mattress frame toward and connects to the adjacent first and second support brackets at a point relatively adjacent to a floor surface the first and second support brackets are resting on.

21. The bed of claim 11, wherein one or more covers are included on a bottom surface of the mattress frame and the one or more covers can be chosen from cloth, wood, and/or white board.

22. A bed, comprising:

a wall attachment including a flat plate having a first end and a second end, wherein each of the first and second ends extend into a first segment bent at a 90-degree angle from the flat plate, each first segment extends into a second segment bent inward at a 90-degree angle parallel to the flat plate, and each second segment extends into a third segment bent at a 90-degree angle extending perpendicularly away from the flat plate;

a first support bracket and a second support bracket connected to the wall attachment, wherein each of the first and second support brackets include a horizontal arm and a vertical arm connected to each other at an angle, wherein the horizontal arm is parallel to a floor surface and the vertical arm extends from the horizontal arm to rest on the floor surface;

a pivoting connection point included at each of the first and second support brackets, wherein the pivoting connection point is assembled by connecting a left side of a mattress frame to the first support bracket and connecting a right side of the mattress frame to the second support bracket; and wherein the wall attachment secures the bed to a wall, and the mattress frame pivots between a horizontal functional position and a vertical stowed position at the pivoting connection point.

23. The bed of claim 22, wherein the flat plate of the wall attachment includes one or more rows of multiple holes extending an entire length of the flat plate, wherein the flat plate is fastened to one or more studs in the wall through one or more holes of the multiple holes that align with the one or more studs in the wall.

24. The bed of claim 22, wherein the horizontal arms on the first and second support brackets are connected to an inside surface of the third segments of the wall attachment as such:

the first support bracket connected to the third segment on the first end of the flat plate; and the second support bracket connected to the third segment on the second end of the flat plate.

25. The bed of claim 22, further including a headboard, wherein the headboard includes legs that are connected to an inside facing surface of the second segment, wherein the headboard is positioned away from the wall the wall attachment is connected to.

26. The bed of claim 22, wherein the pivoting connection point at each connection of the mattress frame to the first and second support brackets includes:

a first opening in each of the left side and the right side of the mattress frame;

a bolt welded on an inside surface of each horizontal arm of the first and second support bracket; and wherein the mattress frame is fitted between the first and second support brackets and the first opening on each of the left and right sides of the mattress is aligned with the bolt in the adjacent horizontal arm of the first and second support brackets, and wherein a washer is disposed between the first opening and the bolt of each pivoting connection point.

27. The bed of claim 22, further including a locking mechanism, wherein the locking mechanism is included on the first and/or second support bracket, and comprises:

a second opening in the right side and/or the left side of the mattress frame;

a third opening in the horizontal arm of the first and/or second support bracket;

a tab with an opening extending from the vertical arm of the first and/or second bracket; and wherein a knob is inserted through the second opening and the third opening to lock the mattress frame in the horizontal functional position, and wherein the knob is inserted through the tab with an opening and the third opening to lock the mattress frame in the vertical stowed position.

28. The bed of claim 22, wherein the mattress frame includes:

one or more guardrails on a first end; and one or more straps along a left and right side of the mattress frame to secure a mattress placed on the mattress frame.

29. The bed of claim 22, further including a lift mechanism included at each of the first and second support bracket and connected to the left and right side of the mattress frame, respectively.

30. The bed of claim 29, wherein a plate is configured on an outside surface of each of the left and right side of the mattress frame adjacent to the pivoting connection point, wherein the plate on each of the left and right side of the mattress frame extends downward past an edge of each of the left and right side, wherein, the lift mechanism on each of the left and right sides of the mattress frame is affixed to an inside facing surface of the plate that extends past the edge of each of the left and right side, and the lift mechanism extends from each of the left and right sides of the mattress frame toward and connects to the adjacent vertical arm of each of the first and second support brackets at a point relatively adjacent to a floor surface the vertical arm is resting on.

31. The bed of claim 22, wherein one or more covers are included on a bottom surface of the mattress frame and the one or more covers can be chosen from cloth, wood, and/or white board.

* * * * *